US005335878A

United States Patent [19]

Jacobsson

[11] Patent Number: 5,335,878

[45] Date of Patent: Aug. 9, 1994

[54] THREAD BRAKING DEVICE

[75] Inventor: Kurt A. G. Jacobsson, Ulricehamm, Sweden

[73] Assignee: IRO AB, Ulricehamm, Sweden

[21] Appl. No.: 941,141

[22] PCT Filed: Mar. 6, 1991

[86] PCT No.: PCT/EP91/00414

§ 371 Date: Nov. 3, 1992

§ 102(e) Date: Nov. 3, 1992

[87] PCT Pub. No.: WO91/14031

PCT Pub. Date: Sep. 19, 1991

[30] Foreign Application Priority Data

Mar. 6, 1990 [SE] Sweden ..... 9000808-7

[51] Int. Cl.[5] ..... B65H 59/24

[52] U.S. Cl. ..... 242/150 R; 242/47.01; 242/131

[58] Field of Search ..... 242/150 R, 150 M, 154, 242/153, 147 R, 149, 157 R, 130, 131, 131.1, 47.01, 47.12, 128

[56] References Cited

U.S. PATENT DOCUMENTS 4,471,917 9/1984 Whisnant ..... 242/131.1 X

FOREIGN PATENT DOCUMENTS 2359550 6/1974 Fed. Rep. of Germany .
373766 8/1949 Italy ..... 242/150 R
503652 4/1971 Sweden .
2027456 2/1980 United Kingdom .

*Primary Examiner*—Stanley N. Gilreath
*Attorney, Agent, or Firm*—Flynn, Thiel, Boutell & Tanis

[57] ABSTRACT

In the case of a thread braking device (B), which is intended to be used especially on the supply side of a thread feeder (F) and which comprises a thread brake (3) having a fixed passage axis (f) and having arranged thereon a shield surface (A) provided with a thread opening (22) and arranged transversely to the direction (R) in which the thread (Y) is supplied, there are provided direction adjustment means (M) for the shield surface (A), with the aid of which the transverse position of said shield surface (A) can be adjusted to supply directions (R1, R2) of the thread (Y) deviating from the passage axis (f). Even in the case of a shield surface (A) for general thread-guiding tasks, which is arranged in a stationary holding means and oriented transversely to the supply direction (R) of the thread (Y), such position adjustment means are provided so that the transverse position of the shield surface (A) can be adjusted to the respective supply direction (R1, R2) of the thread (Y).

12 Claims, 4 Drawing Sheets

THREAD BRAKING DEVICE

DESCRIPTION

The present invention refers to a thread braking device.

When a thread is supplied from a supply coil to a consumer, e.g. a weaving machine or a knitting machine, a thread feeder will be used for eliminating variations of thread tension and for offering the thread to the consumer under the best possible conditions. Thanks to the thread feeders, an extraordinary increase in the processing speed could be achieved without increasing the strength of the thread. The thread feeder, e.g. a thread storage and feed device, has its axis positioned in alignment with the location where the thread is inserted into the consumer, e.g. the shed of a weaving machine, so as to guarantee the smallest possible deflection in the thread path to the consumer. One or several thread supply coil(s) from which the thread feeder draws off the thread can, normally, not be brought into alignment with the then fixed axis of the thread feeder. The reason for this is to be seen in space conditions and in the way in which the operators change the supply coils. The knotting together of threads coming from several supply coils will automatically result in various directions of supply to the thread feeder. For guaranteeing proper functioning of the thread feeder, a certain basic tension of the thread coming from the supply coil will be expedient. Hence, a thread braking device is provided on the supply side of the thread feeder. In order to prevent the incoming thread from getting entangled in the thread braking device, a shield surface is fixedly arranged on the thread braking device, said shield surface being either a flat plate or a spherical cup. The shield surface should be positioned transversely to the supply direction of the thread so that the surface producing the shielding effect is as large as possible. It is therefore necessary to position the thread braking device such that it extends at an oblique angle relative to the axis of the thread feeder. This, however, will result in an undesired deflection of the thread between the thread braking device and the thread feeder, i.e. at a location in the thread path ahead of which the braking device produces tension in the thread. Depending on the deflection angle and the friction, this will cause an augmentation in tension increases and, especially, tension peaks which are generated when the thread is unwound from the supply coil. This will result in the risk of thread breakage.

Sometimes, at least one thread opening has to be arranged in a stationary manner along the path from the supply coil to the consumer. In order to prevent the thread, which is animated (ballooning) during its journey and which will occasionally sag in response to speed variations, from getting entangled in the obstacle formed by said thread opening, the thread opening will be arranged in a large-area shield surface, which is positioned transversely to the supply direction of the thread and which will prevent the thread from getting entangled, whereby thread breakage would be caused.

The present invention is based on the task of providing a thread braking device and a shield surface, respectively, by means of which the above-mentioned disadvantages are avoided. In the case of a thread braking device located on the supply side of a thread feeder, the number of thread breakages is to be reduced. In the case of a shield surface used for general thread guiding tasks, the best possible shielding effect, which will prevent thread breakage in this area, is to be always guaranteed.

The thread braking device, which is intended to be used on the supply side of the thread feeder, can be aligned with the axis of said thread feeder in such a way that there will be no deflection downstream of the thread brake, which would increase the risk of thread breakage. Also the risk of entangling of the thread in the thread braking device is reduced because the shield surface can be adjusted to the supply direction of the thread in each case in such a way that the shield surface which becomes effective is as large as possible.

In the case of a shield surface which is provided with a thread opening and which is used for general thread guiding tasks, said shield surface will produce the optimum shielding effect due to its adjustment to the supply direction. In both cases, it is of essential importance that the shield surface can be adjusted, at least approximately, transversely to the supply direction, and this will be possible with the aid of the direction adjustment means.

In both cases, there is no necessity of providing—as has often been necessary up to now—an oversized shield surface, since said shield surface can individually be adjusted to the thread supply direction. Under the normally narrow space conditions in the case of thread processing, this is of essential importance, since several threads are often supplied to a consumer and since it will then be necessary to coordinate a corresponding number of thread feeders, shield surfaces and thread braking devices as well as an even larger number of supply coils such that they occupy the least possible space.

The direction adjustment means which are constructed as positive engagement arrangement guarantee a precise adjustment of the shield surface as well as exactly reproducable positions of adjustment, whereas the frictional engagement means used for securing the shield surface in position during operation will take up unavoidable reaction forces resulting from vibrations.

An additional advantageous embodiment, in the case of which a basic member is provided, which is adapted to be supported in a stationary manner and which is equipped with a holding member for the shield surface. The holding member fulfills the additional task of contributing to the adjustment of the shield surface.

Another structurally expedient embodiment is the embodiment wherein the shield surface is provided with part of the direction adjustment means.

In another embodiment, the support means of the basic member is additionally used for effecting the respective correct adjustment of the shield surface.

A particularly expedient embodiment, which is reliable in function and easy to handle, the shield surface is reliably held in the rotary connection. Adaptation of the shield surface to the respective supply direction is achieved simply by the rotary motion of the shield surface relative to the basic member and of the basic member relative to the shield surface, said rotary motion being carried out for the purpose of adjustment.

Another embodiment covers, between 0° and 45°, all deviations between the thread passage axis in the thread brake and the supply direction of the thread. If the supply direction should deviate more than 45° from the passage axis, the 45°-inclined position of the shield surface will still produce a sufficient shielding effect. For larger angular deviations, the inclined position angles can also be larger and/or different from one another.

In an additional expedient embodiment, a ball-and-socket joint or a universal joint permits a simple adaptation of the transverse position of the shield surface to arbitrary supply directions of the thread.

Alternatively, the respective adjustment position of the shield surface is established by superimposing a pivotal movement of the shield surface about the axis of rotation and a rotary motion of the basic member about the passage axis.

In another embodiment, the basic member is adapted to be rotated relative to the support means.

It is, however, also imaginable to reposition the basic member with its support means about the passage axis so as to adjust the shield surface to the supply direction of the thread.

In the case of another embodiment a spherical cup will produce a particularly good shielding effect against entanglement.

In a structurally simple and reliable embodiment, the oblique position of the holding means relative to the passage axis and the oblique position of the end face of the extension relative to the shield surface itself determine the maximum possible oblique position of the shield surface, which can be adjusted by rotation. The shield surface is fixed by means of the counternut in the respective position which has been adjusted. The individual components can easily be produced. The respective repositioning operations can be carried out rapidly and with the aid of simple tools. Vibrations will not change the position of adjustment which has been chosen for the shield surface.

With respect to the best possible careful treatment of the thread, the incoming thread is essentially deflected at the thread eye positioned on the supply side. The additional thread eye positioned behind said first-mentioned thread eye will be touched by the thread only in the case of extreme transverse movements.

BRIEF DESCRIPTION OF THE DRAWINGS

Embodiments of the subject matter of the invention will be explained on the basis of the drawings, in which.

DETAILED DESCRIPTION

Figure 1:
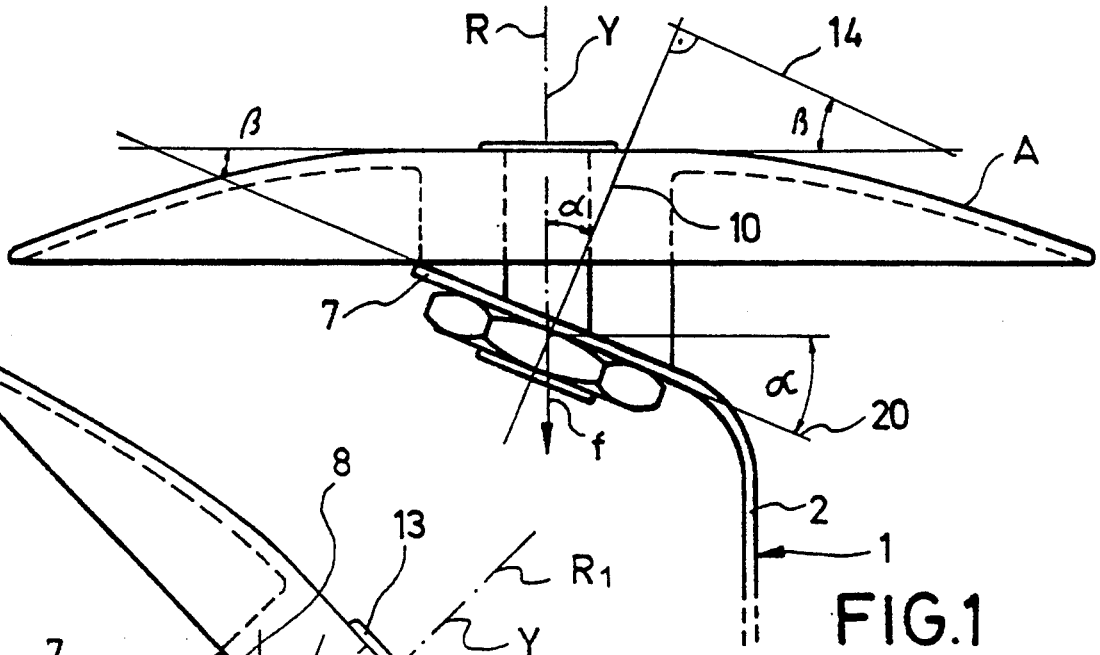
FIG. 1 shows a side view of a thread braking device.
Figure 2:
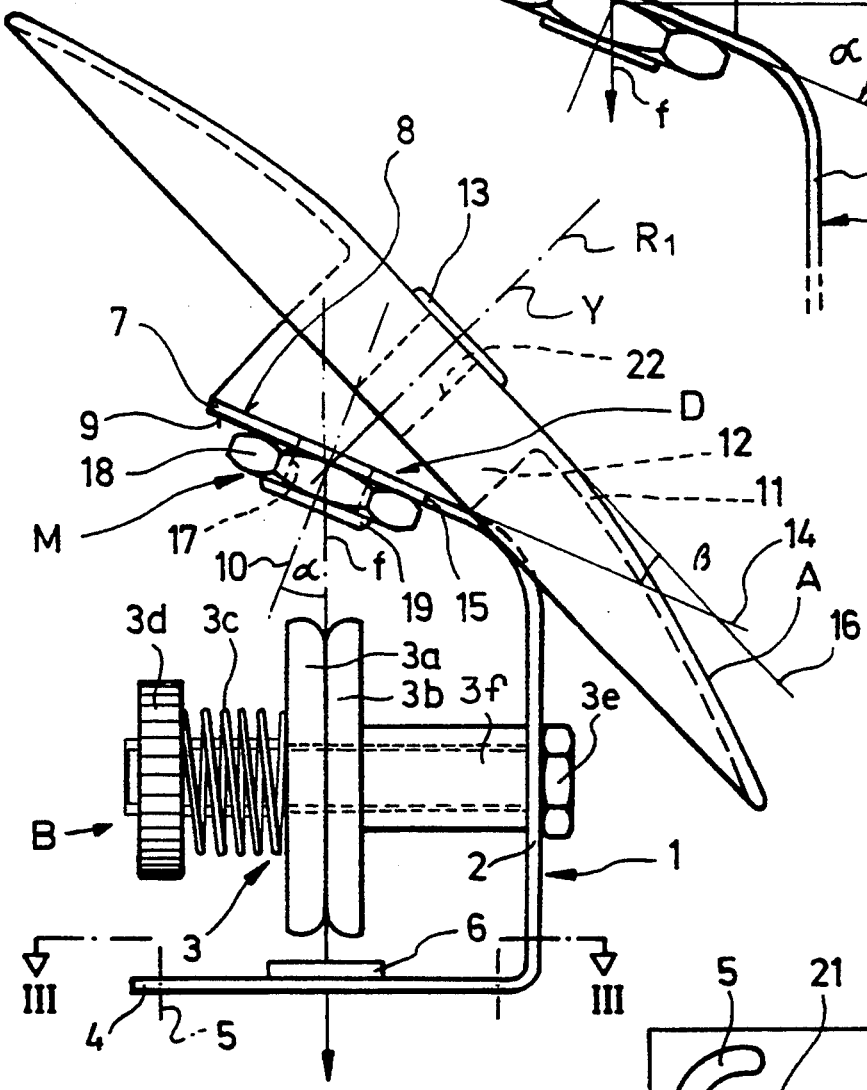
FIG. 2 shows part of the thread braking device of FIG. 1 after an adjustment which has been carried out, FIG. 1 and 2 each representing limit adjustments.
Figure 3:
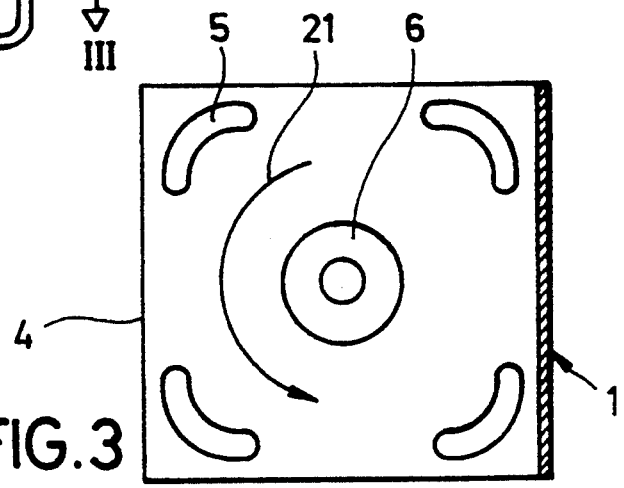
FIG. 3 shows a section in plane III—III of FIG. 2.
Figure 5:
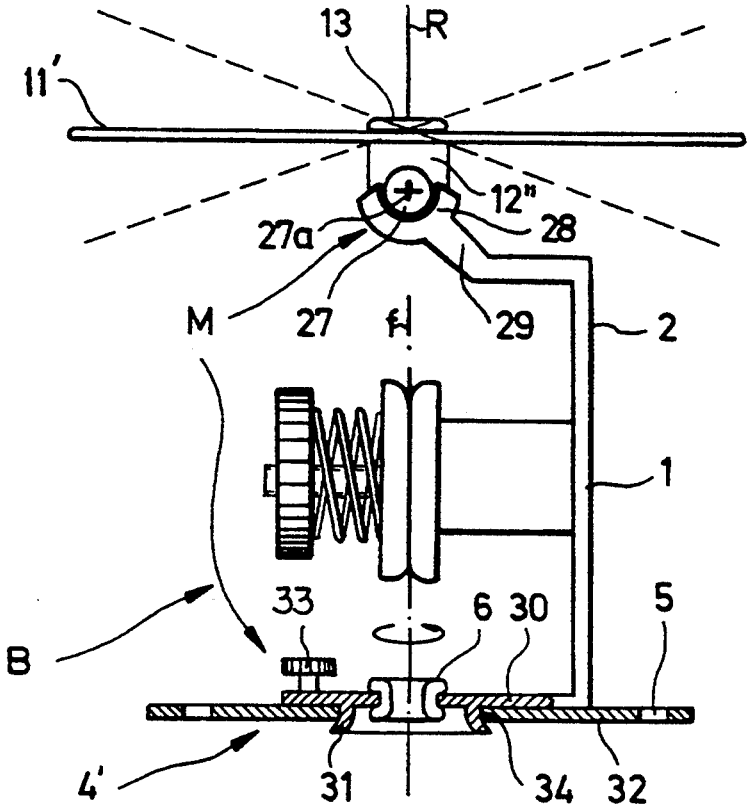
FIG. 5 shows a side view of an additional embodiment of a thread braking device.
Figure 6:
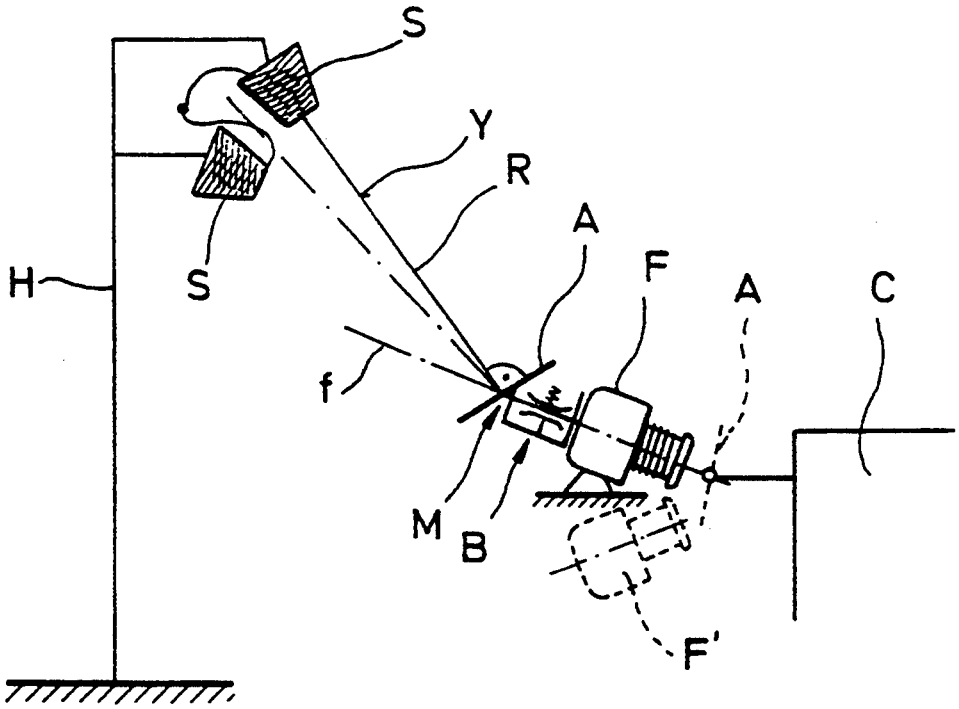
FIG. 6 shows a scheme for elucidating geometrical conditions when a thread is being processed.

FIG. 1 and 2 disclose a thread braking device B of the type provided on the supply side of a thread feeder F when a thread is being processed (FIG. 6). A shield surface A according to FIG. 4 can be integrated in the thread braking device B as disclosed in FIG. 1, 2, 3, 4 and 5. It is, however, also imaginable to arrange the shield surface A according to FIG. 4 without any braking device at a different point in the path of the thread Y in FIG. 6 so as to fulfil general thread guiding functions, e.g. between the thread feeder F and a consumer C.

In FIG. 6, the consumer C is a weaving machine processing the thread Y as a weft thread. The thread Y is stored on thread supply coils S provided in a holding means H. The threads of thread supply coils S belonging together are knotted together so that a change from an empty supply coil S to a full one will take place automatically. The thread feeder F is a thread storage and feed device by means of which the thread Y is drawn off the supply coil S, stored intermediately and offered at a uniformly low thread tension to the consumer C, which will draw off the thread Y according to requirements. The axis of the thread feeder F is approximately in alignment with the point of insertion at the consumer C, e.g. in the case of single-color weaving carried out with one thread feeder.

For reasons of space (in the case of several alternately working thread feeders F, F'), it may be necessary to arrange each thread feeder F such that its axis extends at an oblique angle.

A shield surface A having an incoming thread guide opening 22*a* for the thread, can also be arranged between the thread feeder and the consumer or at a different point of the thread path (FIG. 6), e.g. in the area of an intermediate nozzle or a threading nozzle, which is used for automatic threading and at which the thread is to be prevented from getting entangled in spite of ballooning.

The thread braking device B, which has a thread passage axis f, is installed on the supply side of the thread feeder F.

The supply direction of the thread from the supply coil S deviates from the passage axis f (cf. FIG. 6), said supply direction being referred to by reference symbol R. The thread braking device B has attached thereto a shield surface A, which has to extend at right angles to the supply direction R so as to prevent entanglement in the case of sagging or ballooning. Direction adjustment means M for the shield surface A are provided on the thread braking device B, said direction adjustment means M being used for adapting the transverse position of the shield surface A to the respective supply direction R. The shield surface A can, fundamentally, be adjusted to a mean or average supply direction.

Figure 7:
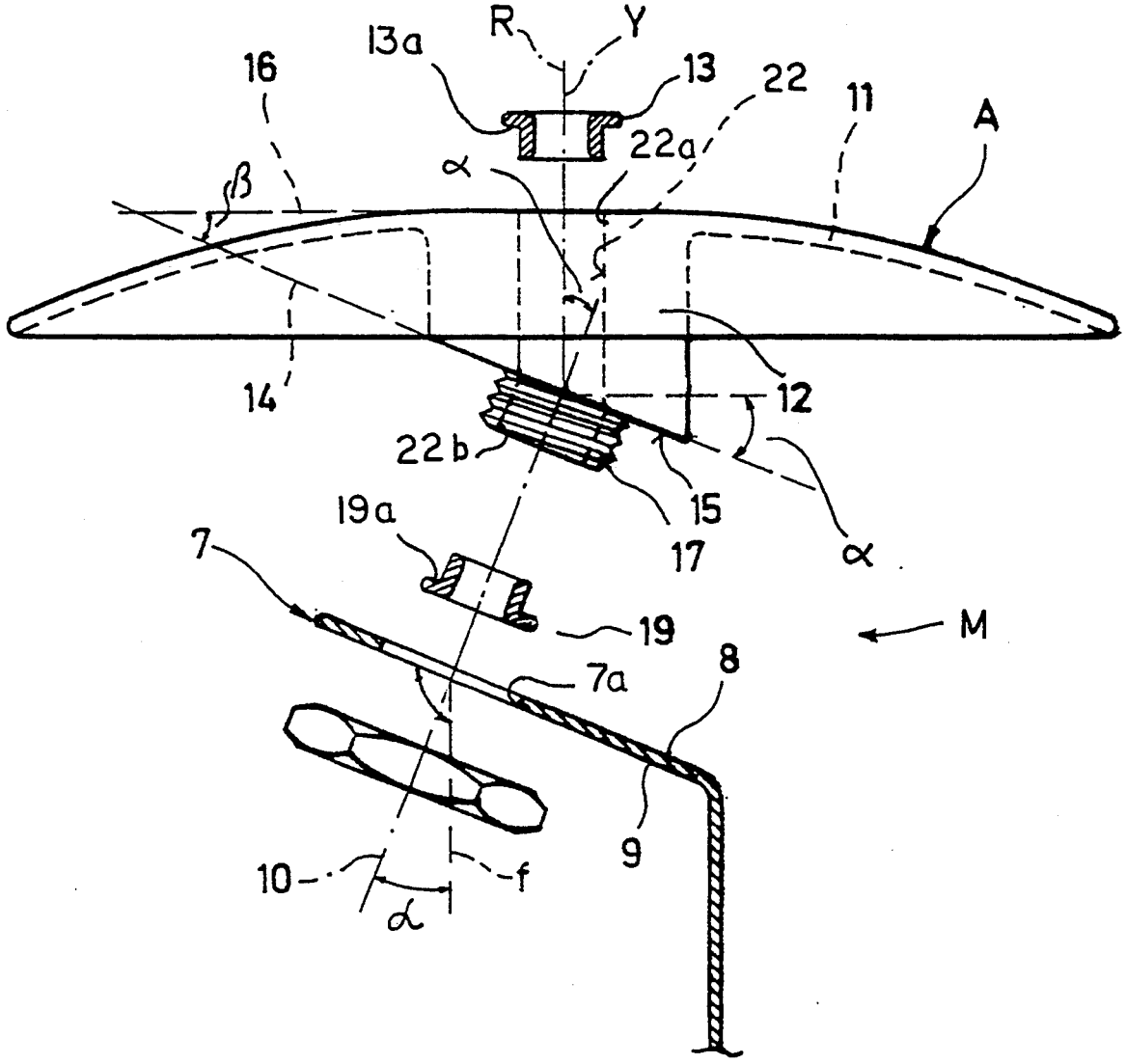
FIG. 7 shows an exploded sectional side view of the thread braking device of FIG. 1.

The thread braking device B according to FIG. 1, 2 and 7 includes a bow-shaped basic member or support frame 1 provided with a holding member 2, which has secured thereto a thread brake 3. In the case of the embodiment shown, the braking device is a disk brake with disks 3*a*, 3*b*, which are pressed together by a spring 3*c* and which are movably supported on a support 3*f* fixed in position by means of a nut 3*e*. The clamping force of the spring 3*c* can be varied by means of an adjustment screw 3*d*.

At the lower end of the holding member 2, a support means or means for rotatably positioning the frame 4 in the form of a quadrangular plate is arranged, which includes fastening means 5, e.g. elongated holes, with the aid of which the thread braking device B is fixed at the supply side of the thread feeder F. The elongated holes 5 are distributed concentrically around a central thread eye 6 so that the basic member 1 can respectively be repositioned by 90° in the direction of an arrow 21, or can be advanced by one throughhole, and so that said basic member 1 can also be rotated to a limited extent.

At the upper end, the holding member 2 is provided with a tongue 7 having an upper surface 8 and a lower surface 9. The thread braking device B has a stationary or fixed incoming thread passage axis f, which is in alignment with the axis of the thread feeder F in FIG. 6 so as to exclude any deflection of the thread Y between the thread brake 3 and the thread feeder.

The direction adjustment means M will be explained hereinbelow. The shield surface A, which is constructed as a shield member or spherical cup 11 consisting of plastic material or of sheet metal, has at its back an extension or central base portion 12 having an end face 15 which extends at an oblique angle B relative to the plane 16 of the shield surface A and which rests on the surface 8 of the tongue 7. The tongue 7 extends at an oblique angle $\phi$ relative to the passage axis f. The extension 12 is provided with a hollow threaded projection 17, which projects through an opening 7*a* of the tongue 7. The projection 17 includes an outgoing thread guide opening 22*b* located close to but downstream of the incoming thread guide opening 22*a*. The outgoing thread guide opening 22*b* permits the incoming thread Y, when discharged from the direction adjustment means, to be supplied to the thread brake B along the fixed thread passage axis f. The outgoing thread guide opening intersects the fixed thread passage axis f when the shield member is adjustably moved between at least first and second adjustment positions which correspond to first and second incoming thread supply directions $R_1$ and $R_2$, respectively. A positive locking means or counternut 18 is screwed onto the threaded projection 17, said counternut 18 abutting on the surface 9 of the tongue 7. The threaded projection 17 has arranged therein a thread eye 19, which consists of ceramics and the center of which is positioned in the passage axis f. A thread eye 13 consisting of ceramics is also arranged within the incoming thread guide opening 22*a* on the supply side of the shield surface A. A thread guide passage 22 extends between the two thread eyes 13 and 19 within the spherical cup 11. The guide passage 22 has a first portion which extends centrally within the extension 12 along a longitudinal central axis oriented perpendicularly to the plane 16, and a second portion which extends centrally within the projection 17 along an axis of rotation 10, which axis 10 extends at an angle to the longitudinal central axis.

Referring now to FIG. 7, there is shown an exploded view of the direction adjustment means M. The direction adjustment means M comprises two parts. The first part includes the extension 12 and the projection 17, and the second part includes the tongue 7 having the bore 7*a* therethrough. The first and second parts cooperate to define a rotary connection D. The threaded projection 17 extends perpendicularly downstream from the end face surface 15 and is oriented along the axis of rotation 10. The thread guide passage 22 terminates at an upstream side with the incoming thread guide opening 22*a*, and terminates at the downstream side with the outgoing thread guide opening 22*b*. The incoming and outgoing thread guide openings 22*a* and 22*b* have the thread eyes 13 and 19 respectively secured therein. Thread eye 13 includes an annular flange 13*a* which abuts shield surface A, and thread eye 19 includes an annular flange 19*a* which abuts a free edge of projection 17. Counternut 18 slidably passes over annular flange 19*a* to threadedly engage the projection 17. The annular flange 19*a* does not extend radially beyond the external threads of the projection 17.

The extension 12 is secured in position on the tongue 7 by means of the rotary connection D. The rotary connection D has the axis of rotation 10, which extends at an oblique angle, perpendicularly to the tongue 7, and which crosses the passage axis f. The axis of rotation 10 extends at an oblique angle $\alpha$ relative to the passage axis f. The angle $\beta$ is provided between the plane 16 of the shield surface A and a plane 14 extending at right angles relative to said axis of rotation 10. In the case of the embodiment shown, the angles $\alpha$ and $\beta$ are each approx. 22.5°. The angles $\alpha$ and $\beta$ can be different from each other, and their sum can exceed 45°.

When the shield surface is to be adjusted, counternut 18 is first loosened, then the spherical cup 11 is rotated about the axis of rotation 10 to obtain the desired shield surface position, and then the counternut 18 is tightened to secure the position of the spherical cup 11 on the tongue 7.

In the first adjustment position of the shield surface A according to FIG. 2, the supply direction R1 of the thread Y deviates from the passage axis f by 45° The extension 12 of the shield surface A has been rotated to a maximum limit position relative to the tongue 7. The angles $\alpha$ and $\beta$ sum to approximately 45°. The plane 16 of the shield surface A extends approximately at right angles to the supply direction R1. By rotating the shield surface A (after having loosened the counternut 18), said shield surface A can be adjusted to any thread supply direction between 0° and 45°.

In FIG. 1, it is indicated that, in the second limit position of the shield surface A, the two angles $\alpha$ and $\beta$ nullify each other, and that straight passage in the direction of the passage axis f is given for a thread supply direction R which is in alignment with said passage axis f. The angle $\alpha$, is defined between the axis of rotation 10 and the passage axis f, whereras the angle $\beta$ is to be measured between the plane of the shield surface A and a plane 14, which extends at right angles to the axis of rotation 10.

If the supply direction R1 lies in the plane of the drawing such that the thread is supplied from the left side to the thread braking device B, the basic member 1 will be repositioned by 180° about the passage axis f. If the supply direction R1 extends into the plane of the drawing from the front or from the rear, the basic member 1 will be repositioned accordingly and rotated in the elongated holes 5 such that the plane 16 of the shield surface extends approximately at right angles to said supply direction.

Figure 4:
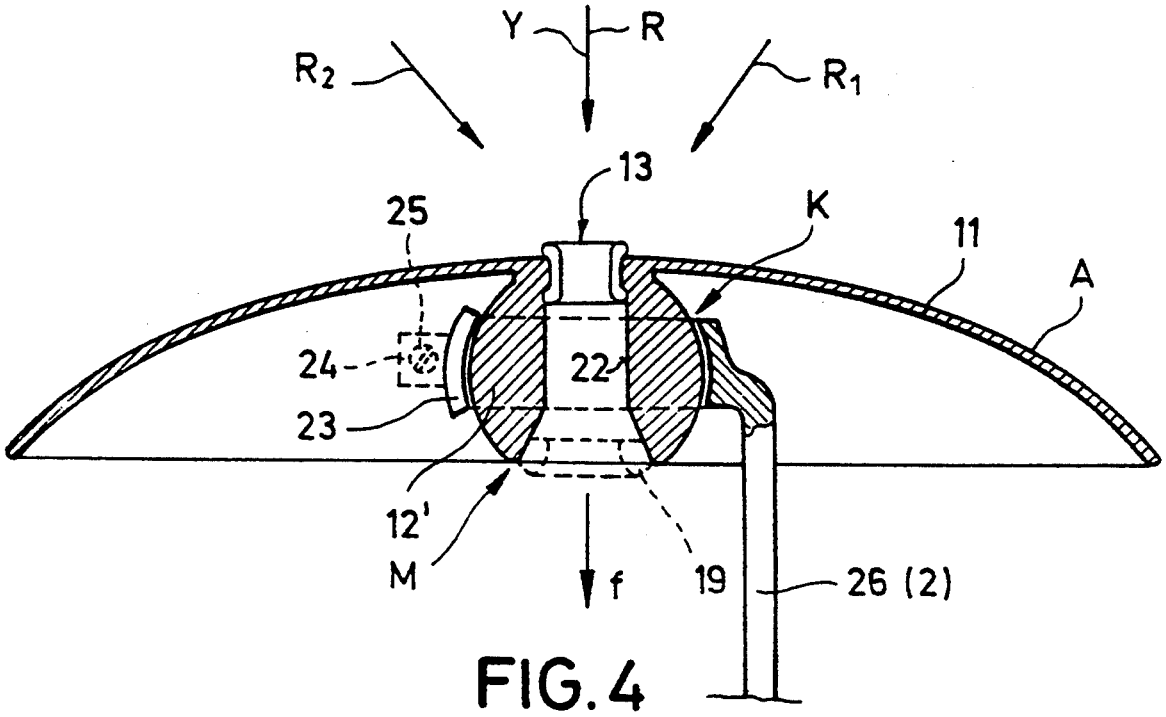
FIG. 4 shows a sectional side view of a shield surface which is supported in a stationary manner and which belongs e.g. to a thread braking device.

The shield surface A according to FIG. 4 is a spherical cup consisting of plastic material or of sheet metal. At the back of said spherical cup 11, an extension 12' is formed, which has approximately the shape of a ball and through which the thread opening 22 extends; the thread eye 13 and, possibly, but not necessarily, the additional thread eye 19 are positioned in said thread opening 22. The ball-shaped surface of the extension 12' is enclosed by a spherical holding ring 23, which can be slotted, if desired, and which is provided with tensioning projections 24 for a locking screw 25. In this way, a ball-and-socket joint K is formed between a stationary holding means 26, which can also be the holding member 2 of FIG. 1, and the shield surface A, said ball-and-socket joint K permitting the transverse position of the shield surface A to be adapted to the respective supply direction R (in alignment with the passage axis f) or R1 or R2 (extending both at an oblique angle to the passage axis f).

The shield surface A according to FIG. 4 may also be used independently for thread-guiding tasks at locations at which a thread eye or thread opening (13, 22, 19), in which the incoming thread must not get entangled, is required in the thread path. By means of the ball-and-socket joint K, the shield surface A can be adjusted in each case to a position in which it extends approximately at right angles to the supply direction. Instead of a ball-and-socket joint it would just as well be possible to use a universal joint or a cardan joint. If the ball-and-socket joint K is used as direction adjustment means M in the case of a thread braking device B according to FIG. 6, it will not be necessary to reposition the basic member 1 about the passage axis f because the shield surface A can be adjusted to all sides.

In the case of the embodiment of the thread braking device B of FIG. 5, part of the direction adjustment means M is formed between the shield surface A and the holding member 2 of the basic member 1, whereas another part of said direction adjustment means is formed in the area of the support means 4' of the basic member 1.

The shield surface A is defined by a circular or oval flat plate 11', which consists of plastic material or of sheet metal and which has centrally arranged therein the thread eye 13 provided on the supply side. The extension 12'' arranged at the back of the shield surface A has two diametrically opposed studs 27 defining a transverse axle 27*a*, which crosses the passage axis f. The studs 27 are frictionally held in pivot bearings 28, preferably in fork-shaped pivot bearings. The pivot bearings 28 are attached to a fork-shaped holding member 29, which is integrally connected with the holding member 2.

An opening of a base plate 30 has arranged therein the thread eye 6, which is provided on the outlet side. Said plate 30 is equipped with a circular collar 31, which is in engagement, e.g. in frictional engagement, with an opening 34 of a base plate 32.

The fastening means 5 are provided in said base plate 32. A locking screw 33 secures the rotary position of the basic member 1 about the passage axis f. A similar fastening screw may also be provided between the studs 27 and the pivot bearings 28, or in the ball-and-socket joint K in FIG. 4. Depending on the respective supply direction R, the shield surface A is rotated about the transverse axle 27*a* and the basic member 1 is rotated about the passage axis f, until the shield surface A extends approximately at right angles to the supply direction of the thread.

A lamella brake, a thread brake having two opposing brake elements (commonly known as a crocodile brake), a brake operating with a member around which the thread is at least partially wound, a slack take-up device producing a braking effect, a deflection brake or the like can be used instead of the disk brake 3.

I claim:

1. A thread braking device for use on the supply side of a thread feeder, such as a thread storage and feed device, comprising a support frame, a thread brake having a fixed thread passage axis, a shield member having an enlarged shield surface positionable to extend generally perpendicularly relative to a supply direction of a thread incoming from a supply to the thread brake, the shield member positioned for cooperation with the incoming thread upstream of the brake and having an incoming thread guide opening formed in and extending through said shield surface, direction adjustment means for permitting the shield surface to be adjustably moved between at least first and second positions which correspond to first and second incoming thread supply directions, and positive locking means for maintaining the shield surface at a desired position which is generally perpendicular to the incoming thread direction, said direction adjustment means including an outgoing thread guide opening disposed close to but located downstream of said incoming thread guide opening for permitting the incoming thread when discharged from the direction adjustment means to be supplied to the thread brake along the fixed thread passage axis, said outgoing thread guide opening being positioned for intersecting said fixed thread passage axis when said shield member is in said first and second positions.

2. The brake device according to claim 1, wherein said direction adjustment means further includes a first part which is fixed to and projects downstream of said shield member and defines a thread guide passage which at least in part is aligned with and projects downstream from said incoming thread guide opening, said outgoing thread guide opening being defined by said passage adjacent a downstream end thereof, said direction adjustment means also including a second part associated with said frame and rotatably supporting said first part so that the latter can be rotatably displaced between said first and second positions which respectively correspond to first and second incoming thread directions which are inclined with respect to one another so that the shield surface extends generally perpendicularly with respect to the incoming thread direction of the respective position.

3. The brake device according to claim 2 wherein said first part and said second part form a rotary connection having an axis of rotation that intersects said fixed thread passage axis at a first oblique angle, said shield surface being arranged at a second oblique angle relative to a plane extending at right angles to said axis of rotation.

4. The thread brake device as claimed in claim 3, wherein said first oblique angle and said second oblique angle are each approximately equal to 22.5°.

5. The brake device according to claim 4, wherein said first and second oblique angles sum to approximately 45° when said shield member is in said first position, and said first and second oblique angles sum to approximately 0° when said shield member is in said second position.

6. The braking device according to claim 2, wherein said direction adjustment means further includes means for rotatably positioning said frame with respect to said fixed thread passage axis, and fastening means for fixedly securing said frame to said thread storage and feeding device to maintain a desired frame position relative to said thread storage and feed device.

7. The brake device according to claim 2, wherein the first part includes a central base portion projecting downstream from said shielding surface along a longitudinal central axis and having an end wall projecting at a first oblique angle with respect to said shielding surface, and an externally threaded projection extending transversely from said end wall along an axis of rotation.

8. The brake device according to claim 7, wherein said frame includes a holding member, a tongue member extending at a second oblique angle with respect to said holding member, and support means for securing said frame to a supply side of said thread storage and feed device.

9. The brake device according to claim 8, wherein said second part includes an aperture in said tongue member, said projection having a free end thereof extending through said aperture, and said tongue member rotatably supporting said end wall of said central base portion on a first surface of said tongue member.

10. The brake device according to claim 9, wherein said positive locking means includes a counternut which threadably engages said free end of said projection, and which threadably abuts a second surface of said tongue member to fixedly secure said shield member at a selected position.

11. The brake device according to claim 1, wherein said incoming thread guide opening includes a first thread eye disposed therein, and said outgoing thread guide opening includes a second thread eye disposed therein.

12. The brake device according to claim 11, wherein said first and second thread guide openings are formed from a ceramic material.

* * * * *